US008290770B2

(12) United States Patent
Lee et al.

(10) Patent No.: US 8,290,770 B2
(45) Date of Patent: Oct. 16, 2012

(54) METHOD AND APPARATUS FOR SINUSOIDAL AUDIO CODING

(75) Inventors: Nam-suk Lee, Suwon-si (KR); Geon-hyoung Lee, Hwaseong-si (KR); Jae-one Oh, Yongin-si (KR); Chul-woo Lee, Suwon-si (KR); Jong-hoon Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1177 days.

(21) Appl. No.: 12/026,066

(22) Filed: Feb. 5, 2008

(65) Prior Publication Data

US 2008/0294445 A1 Nov. 27, 2008

(30) Foreign Application Priority Data

Mar. 16, 2007 (KR) ..... 10-2007-0026268

(51) Int. Cl.
*G10L 19/14* (2006.01)

(52) U.S. Cl. ..... 704/211; 704/200; 704/203; 704/205; 704/227; 704/229; 704/500; 381/18; 381/23; 381/309; 381/74; 380/236

(58) Field of Classification Search ..... 704/203, 704/200, 205, 227, 229, 500; 380/236; 381/18, 381/23, 309, 74
See application file for complete search history.

(56) References Cited

U.S. PATENT DOCUMENTS 4,856,068 A * 8/1989 Quatieri et al. ..... 704/227
7,181,019 B2 * 2/2007 Breebaart et al. ..... 381/23
7,739,106 B2 * 6/2010 Oomen et al. ..... 704/205
7,936,887 B2 * 5/2011 Smyth ..... 381/74
2002/0007268 A1 1/2002 Oomen et al.
2003/0083886 A1 * 5/2003 Den Brinker et al. ..... 704/500
2004/0162721 A1 * 8/2004 Oomen et al. ..... 704/203
2005/0080621 A1 * 4/2005 Tsushima et al. ..... 704/229
2005/0259822 A1 * 11/2005 Sluijter et al. ..... 380/236
2006/0009967 A1 * 1/2006 Gerrits et al. ..... 704/200
2006/0015328 A1 1/2006 Van Schijndel et al.
2006/0036431 A1 2/2006 den Brinker et al.
2006/0045294 A1 * 3/2006 Smyth ..... 381/309

(Continued)

OTHER PUBLICATIONS

Mathieu et al., 2005, Tracking Partials for the Sinusoidal Modeling of Polyphonic Sounds, France Telecom R&D, all pages.*

(Continued)

*Primary Examiner* — Michael Colucci
(74) *Attorney, Agent, or Firm* — Sughrue Mion, PLLC

(57) ABSTRACT

Provided are a method and apparatus for sinusoidal audio coding, which employs a tracking method for further effective coding of sinusoids extracted in the process of a sinusoidal analysis of parametric coding. The sinusoidal audio coding method includes: extracting sinusoids of a current frame by performing a sinusoidal analysis on an input audio signal; with respect to each of the extracted sinusoids, setting a mode selected from a birth mode in which a sinusoid is newly generated irrespective of sinusoids of a previous frame, a continuation mode in which the sinusoid is only one sinusoid continued from one of the sinusoids of the previous frame, and a branch mode in which the sinusoid is one of a plurality of sinusoids continued from one of the sinusoids of the previous frame; and coding the extracted sinusoids according to the selected mode. Accordingly, a plurality of sinusoids that can be continued from one previous track component are set to the continuation mode or the branch mode. Therefore, the number of bits of coded data is significantly reduced, compared with the case of the birth mode.

27 Claims, 5 Drawing Sheets

U.S. PATENT DOCUMENTS

| | | | | |
|---|---|---|---|---|
| 2006/0147048 | A1* | 7/2006 | Breebaart et al. | 381/23 |
| 2007/0027678 | A1* | 2/2007 | Hotho et al. | 704/203 |
| 2007/0100639 | A1* | 5/2007 | Den Brinker et al. | 704/500 |
| 2007/0127729 | A1* | 6/2007 | Breebaart et al. | 381/18 |

OTHER PUBLICATIONS

Mathieu et al., Tracking Partials for the Sinusoidal Modeling of Polyphonic Sounds, France Telecom R&D, 2005, all pages.*

Communication dated Aug. 23, 2011 from the Korean Intellectual Property Office in a counterpart application No. 10-2007-0026268.

European Search Report issued Oct. 12, 2011 in counterpart European Application No. 08712448.3.

Schuijers, et al., "Advances in Parametric Coding for High-Quality Audio", IEEE Benelux Workshop on Model Based Processing and Coding Ofaudio, XX, XX, Nov. 15, 2002, pp. 73-79, XP001156065.

* cited by examiner

METHOD AND APPARATUS FOR SINUSOIDAL AUDIO CODING

CROSS-REFERENCE TO RELATED PATENT APPLICATION

This application claims priority from Korean Patent Application No. 10-2007-0026268, filed on Mar. 16, 2007, in the Korean Intellectual Property Office, the disclosure of which is incorporated herein in its entirety by reference.

BACKGROUND OF THE INVENTION

1. Field of the Invention

Methods and apparatuses consistent with the present invention relate to audio signal coding, and more particularly, to tracking of sinusoids in parametric coding.

2. Description of the Related Art

Parametric coding is an audio signal coding method used for a monaural signal. The parametric coding conforms to the moving picture experts group (MPEG)-4 standard.

FIG. 1 is an illustration for explaining a parametric coding method. In the parametric coding method, an input signal is analyzed and parameterized. The input audio signal is first subject to an audio reading and filtering process, followed by a transient analysis, a sinusoidal analysis, and a noise analysis. As a result, parameters of respective audio components are extracted. The transient analysis is provided to compensate for significantly dynamic changes in the audio signal. The sinusoidal analysis is provided to compensate for deterministic changes in the audio signal. The noise analysis is provided to compensate for stochastic or non-deterministic changes in the audio signal.

The extracted parameters are subject to a bit-stream formatting process.

Methods and apparatuses consistent with the present invention particularly relate to the sinusoidal analysis. A sinusoid, also referred to as a partial, is generated as a result of the sinusoidal analysis.

In the parametric audio coding, after the sinusoid analysis is performed, the sinusoid is subject to an adaptive differential pulse code modulation (ADPCM) or a differential pulse code modulation (DPCM). To this end, partials (sinusoids) have to be tracked.

A conventional tracking method employs only two modes, a birth mode and a continuation mode.

The continuation mode is set when one partial has a correlation with another partial of a previous frame (this is referred to as being continued). Once the continuation mode is set, coding may be carried out using information on partials of the previous frame. Thus, the number of bits required for coding decreases.

On the other hand, with respect to the remaining partials which are not set to the continuation mode, the birth mode is set. Once the birth mode is set, a large number of bits are required to code the partials. Thus, coding efficiency deteriorates.

In the conventional method, one partial can be tracked by only another partial. Thus, even when a plurality of similar partials are continuously arranged with respect to one partial of a previous frame, the remaining partials which are not set to the continuation mode have to be set to the birth mode, which requires more bits.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Exemplary embodiments of the present invention provide a method and apparatus for sinusoidal audio coding, which employs a tracking method for further effective coding of sinusoids extracted in the process of a sinusoidal analysis of parametric coding.

The present invention also provides a computer-readable medium having embodied thereon a computer program for executing the method of sinusoidal audio coding.

According to an aspect of the present invention, there is provided a sinusoidal audio coding method including extracting sinusoids of a current frame by performing a sinusoidal analysis on an input audio signal; with respect to each of the extracted sinusoids, setting a mode selected from a birth mode in which a sinusoid is newly generated irrespective of sinusoids of a previous frame, a continuation mode in which the sinusoid is only one sinusoid continued from one of the sinusoids of the previous frame, and a branch mode in which the sinusoid is one of a plurality of sinusoids continued from one of the sinusoids of the previous frame; and coding the extracted sinusoids according to the selected mode.

The setting of a mode may include determining a first previous track component which is included in the sinusoids of the previous frame and is nearest to a sinusoid whose mode is to be set; determining whether the sinusoid whose mode is to be set can be continued from the first previous track component; if the sinusoid whose mode is to be set cannot be continued from the first previous track component, setting the mode of the sinusoid to the birth mode; and if the sinusoid whose mode is to be set can be continued from the first previous track component, setting the mode of the sinusoid to the continuation mode or the branch mode, where one of the sinusoids of the previous frame is assigned as its previous track component.

The determining of a first previous track component may include selecting the first previous track component from the sinusoids of the previous frame having a smallest frequency difference with respect to the sinusoid whose mode is to be set.

The setting of the mode of the sinusoid to the continuation mode or the branch mode may include, if only one sinusoid is continued from the first previous track component among the extracted sinusoids, setting the mode of the sinusoid to the continuation mode, where the first previous track component is assigned as its previous track component.

The setting of the mode of the sinusoid to the continuation mode or the branch mode may further include, if a plurality of sinusoids are continued from the first previous track component among the extracted sinusoids, determining whether the sinusoid whose mode is to be set is nearest to the first previous track component among the sinusoids continued from the first previous track component; and if the sinusoid whose mode is to be set is nearest to the first previous track component, setting the mode of the sinusoid to the continuation mode, where the first previous track component is assigned as its previous track component.

The setting of the mode of the sinusoid to the continuation mode or the branch mode may further include, if the sinusoid whose mode is to be set is not nearest to the first previous track component, determining a second previous track component nearest to the sinusoid whose mode is to be set from the sinusoids which are included in the previous frame and are not assigned as previous track components of the sinusoids of the current frame; determining whether the sinusoid whose mode is to be set can be continued from the second previous track component; if the sinusoid whose mode is to be set cannot be continued from the second previous track component, the mode of the sinusoid is set to the branch mode, where the first previous track component is assigned as its previous track component; and if the sinusoid whose mode is to be set can be continued from the second previous track component, setting the mode of the sinusoid by comparing a data size of coded data obtained in the continuation mode and a data size of coded data obtained in the branch mode.

The setting of the mode of the sinusoid by comparing data sizes may include obtaining a first data size which results from a coding when the sinusoid is set to the branch mode, where its previous track component is the first previous track component; obtaining a second data size which results from a coding when the sinusoid set to the continuation mode, where its previous track component is the second previous track component; if the first size is less than the second size, setting the mode of the sinusoid to the branch mode, where the first previous track component is assigned as its previous track component; and if the first size is equal to or greater than the second size, setting the mode of the sinusoid to the continuation mode, where the second previous track component is assigned as its previous track component.

The determining of a second previous track component may include selecting the second previous track component from the sinusoids which are included in the previous frame and are not assigned as previous track component of sinusoids of the current frame, where the selected second previous track component has the smallest frequency difference with respect to the sinusoid whose mode is to be set.

Continuity of sinusoids may be determined according to whether a frequency difference between sinusoids whose continuity is being determined is equal to or less than a predetermined value or according to whether a frequency difference between the sinusoids is equal to or less than a predetermined value and whether an amplitude ratio of the sinusoids is equal to or less than another predetermined value.

The coding of the extracted sinusoids may include, if the mode of the extracted sinusoid is the branch mode, generating data including a value indicating the number of sinusoids continued from the extracted sinusoid among sinusoids of subsequent frames, a previous track component of the extracted sinusoid, a value indicating a frequency difference and a phase difference between the extracted sinusoid and the previous track component, and a value indicating an amplitude difference between the extracted sinusoid and the previous track component.

According to another aspect of the present invention, there is provided a sinusoidal audio coding apparatus including a sinusoidal analyzer extracting sinusoids of a current frame by performing a sinusoidal analysis on an input audio signal; a mode setting unit setting a mode selected from a birth mode in which a sinusoid is newly generated irrespective of sinusoids of a previous frame, a continuation mode in which the sinusoid is only one sinusoid continued from one of the sinusoids of the previous frame, and a branch mode in which the sinusoid is one of a plurality of sinusoids continued from one of the sinusoids of the previous frame, with respect to each of the extracted sinusoids; and a sinusoid coder coding the extracted sinusoids according to the selected mode.

BRIEF DESCRIPTION OF THE DRAWINGS

The above and other exemplary aspects of the present invention will become more apparent by describing in detail exemplary embodiments thereof with reference to the attached drawings in which.

DETAILED DESCRIPTION OF EXEMPLARY EMBODIMENTS OF THE INVENTION

Hereinafter, exemplary embodiments of the present invention will be described in detail with reference to the accompanying drawings.

As described above in the description of the related art, there is a problem in that coding efficiency deteriorates when one partial can be tracked using only another partial. Thus, in an audio coding method and apparatus according to the present invention, one partial of a previous frame can be tracked using one or more partials.

To this end, three modes are defined for respective sinusoids. The modes include a birth mode, a continuation mode, and a branch mode.

In the birth mode, a current sinusoid (partial) is newly generated irrespective of sinusoids of a previous frame.

In the continuation mode, the current sinusoid is only one sinusoid continued from one of the sinusoids of the previous frame.

In the branch mode, the current sinusoid is one of a plurality of sinusoids continued from one of the sinusoids of the previous frame.

Figure 1:
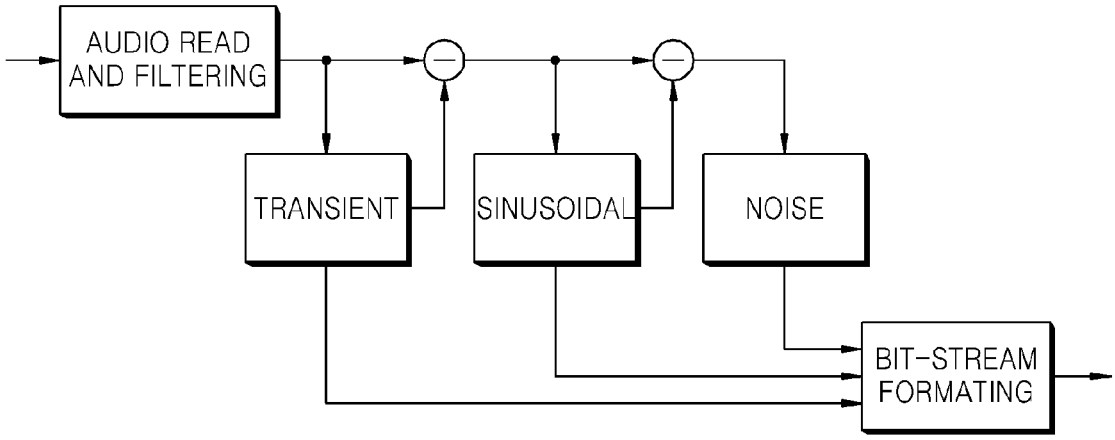
FIG. 1 illustrates an example of parametric coding.
Figure 2:
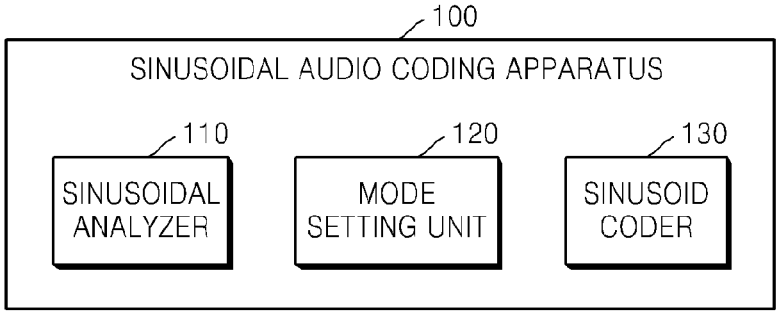
FIG. 2 is a block diagram of a sinusoidal audio coding apparatus according to an exemplary embodiment of the present invention.

FIG. 2 is a block diagram of a sinusoidal audio coding apparatus according to an exemplary embodiment of the present invention.

Referring to FIG. 2, a sinusoidal audio coding apparatus 100 may include a sinusoidal analyzer 110, a mode setting unit 120, and a sinusoid coder 130.

The sinusoidal analyzer 110 performs a sinusoidal analysis on an input audio signal and thus extracts sinusoids of a current frame. The sinusoidal analyzer 110 operates using a conventional sinusoidal analysis method, and thus operations thereof will be omitted.

The mode setting unit 120 allows the extracted sinusoids to be respectively set to one of modes selected from a birth mode, a continuation mode, and a branch mode.

As described above, in the birth mode, a current sinusoid (partial) is newly generated irrespective of sinusoids of a previous frame. In the continuation mode, the current sinusoid is only one sinusoid continued from one of the sinusoids of the previous frame. In the branch mode, the current sinusoid is one of a plurality of sinusoids continued from one of the sinusoids of the previous frame.

According to the mode assigned to the extracted sinusoids, the sinusoid coder 130 codes the sinusoids.

Figure 3:
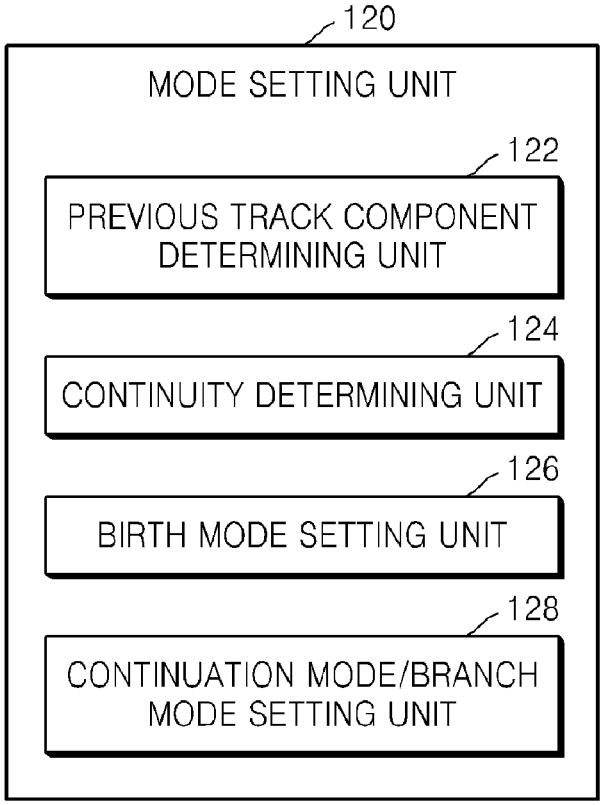
FIG. 3 is a block diagram of a mode setting unit according to an exemplary embodiment of the present invention.

FIG. 3 is a block diagram of a mode setting unit according to an exemplary embodiment of the present invention.

Referring to FIG. 3, a mode setting unit 120 may include a previous track component determining unit 122, a continuity determining unit 124, a birth mode setting unit 126, and a continuation mode/branch mode setting unit 128.

The previous track component determining unit 122 determines a sinusoid which is included in a previous frame and is nearest to a sinusoid whose mode is to be set at the moment. The determined sinusoid is defined as a first previous track component.

A similarity between two sinusoids is preferably determined according to a frequency difference there-between. According to an exemplary embodiment of the present invention, in order to select the first previous track component, the previous track component determining unit 122 selects a sinusoid which is included in the previous frame and has a smallest frequency difference with respect to a current sinusoid whose mode is to be set at the moment.

The continuity determining unit 124 determines whether the current sinusoid can be continued from the first previous track component.

A sinusoid can be continued from another sinusoid when the sinusoids have a correlation. In this case, correlated information is shared, and thus information on one sinusoid can be used to predict another sinusoid. Therefore, data coding can be effectively carried out.

A frequency difference between sinusoids may be used to determine whether the sinusoids can be continued. In addition to the frequency difference, an amplitude ratio between the sinusoids may also be used. Furthermore, various standards used in the conventional sinusoid tracking method may also be used.

In the case of using a frequency difference, it is determined whether the frequency difference between two sinusoids whose continuity is to be determined is equal to or less than a predetermined value. If it is equal to or less than the predetermined value, the two sinusoids can be determined to have a correlation. For example, if the frequency difference is equal to or less than 0.4 equivalent rectangular bandwidth (ERB) rate, the two sinusoids may be determined to be continued from each other.

In the case of using a frequency difference and an amplitude difference, if the frequency difference between the two sinusoids is equal to or less than a predetermined value, and an amplitude ratio between the two sinusoids is equal to or less then a predetermined value, the two sinusoids can be determined to be continued from each other. For example, if the frequency difference is equal to or less than 0.4 ERB, and the amplitude of the current sinusoid is equal to or greater than ⅓ times the amplitude of the previous sinusoid and equal to or less than 3 times the amplitude of the previous sinusoid, then the two sinusoid may be determined to be continued from each other.

The continuity determining unit 124 estimates whether the sinusoid whose mode is to be set at the moment can be continued from the first previous track component. According to the determination result, the birth mode setting unit 126 or the continuation mode/branch mode setting unit 128 sets the sinusoid to a desired mode.

If the sinusoid cannot be continued from the first previous track component, the birth mode setting unit 126 sets the sinusoid to the birth mode.

Otherwise, the continuation mode/branch mode setting unit 128 sets the sinusoid to the continuation mode or the branch mode.

When the current sinusoid is set to the continuation mode or the branch mode, there is a need to indicate a sinusoid of the previous frame from which the current sinusoid is continued. A sinusoid which is included in the previous frame and from which the sinusoid of the current frame is continued, is defined as a 'previous track component' for the sinusoid whose mode is to be set at the moment.

The operation of the continuation mode/branch mode setting unit 128 will be described later in greater detail with reference to FIG. 7.

Figure 4:
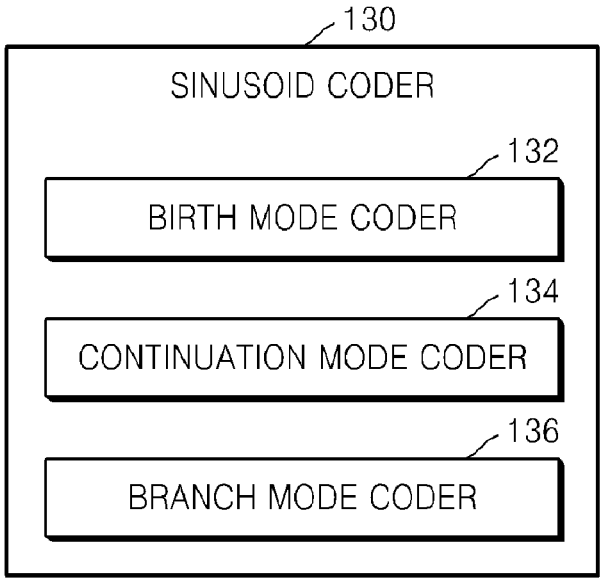
FIG. 4 is a block diagram of a sinusoid coder according to an exemplary embodiment of the present invention.

FIG. 4 is a block diagram of a sinusoid coder according to an exemplary embodiment of the present invention. Referring to FIG. 4, a sinusoid coder 130 may include a birth mode coder 132, a continuation mode coder 134, and a branch mode coder 136.

The birth mode coder 132 codes a sinusoid that is assigned the birth mode. A frequency, a phase, and an amplitude of the sinusoid are coded by the birth mode coder 132. The birth mode coder 132 of the present invention uses the conventional coding method of coding the sinusoid set to the birth mode, and thus detailed descriptions thereof will be omitted.

The continuation mode coder 134 codes a sinusoid assigned the continuation mode. The continuation mode coder 134 compares a frequency, a phase, and an amplitude of a previous track component with those of a current sinusoid and codes only differences thereof. Thus, the number of bits of coded data is significantly reduced. The continuation mode coder 134 of the present invention uses the conventional coding method of coding the sinusoid set to the continuation mode, and thus detailed descriptions thereof will be omitted.

The branch mode coder 136 codes a sinusoid set to the branch mode. The operation of the branch mode coder 136 will be described later in detail with reference to FIG. 8.

Figure 5:
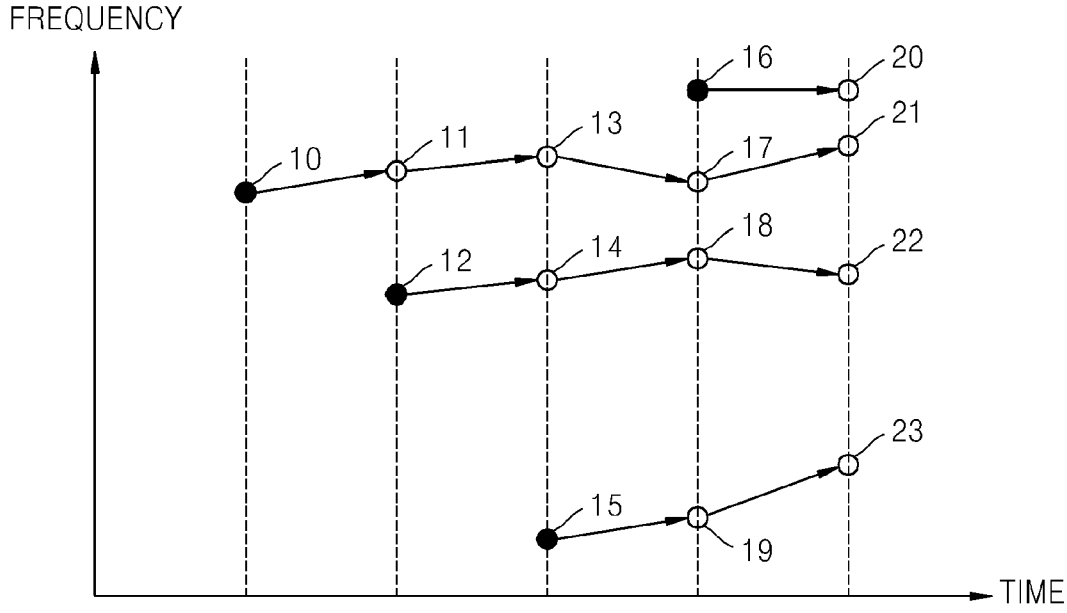
FIGS. 5 and 6 are graphs illustrating a comparison result with and without a branch mode according to an exemplary embodiment of the present invention.
Figure 6:
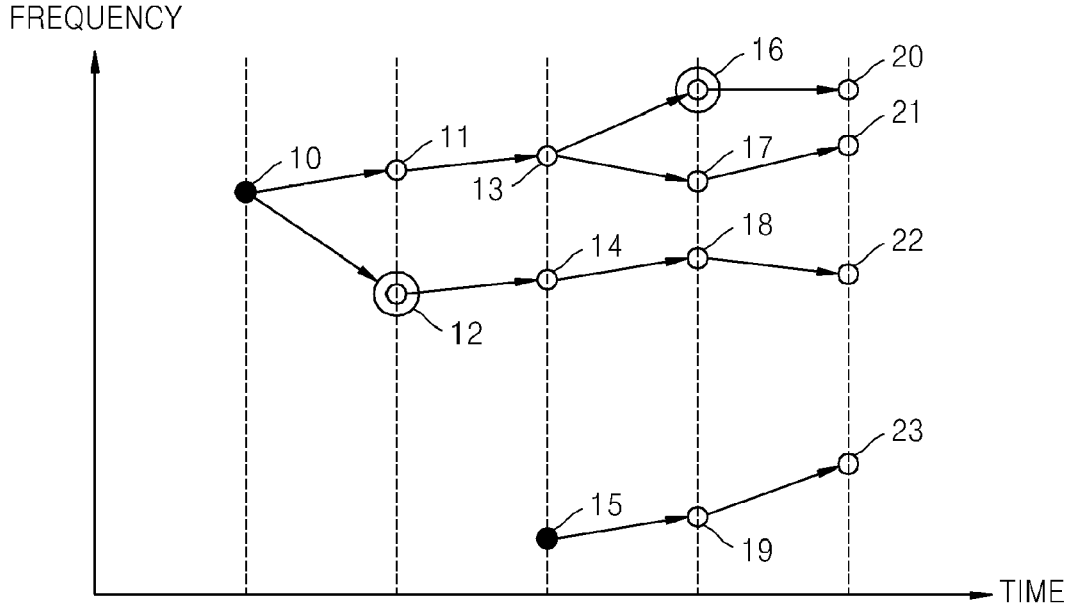

FIGS. 5 and 6 are graphs illustrating a comparison result with and without a branch mode according to an exemplary embodiment of the present invention.

FIG. 5 illustrates conventional sinusoid tracking. In FIG. 5, sinusoids are indicated by dots ● and ○. The horizontal vertical axis denotes time, and respective frames are distinguished by dotted lines.

In a first frame, a sinusoid 10 is newly generated irrespective of sinusoids of a previous frame of the sinusoid 10. Thus, the sinusoid 10 is set to the birth mode. This is indicated by ●.

A second frame includes a sinusoid 11 and a sinusoid 12. It will be assumed that the sinusoids 11 and 12 are within the range that can be continued from the sinusoid 10 of their previous frame.

The number of sinusoids that can be set to the continuation mode with respect to one sinusoid is only one. Thus, between the sinusoids 11 and 12, the sinusoid 11 is set to the continuation mode because it is nearer to the sinusoid 10. This is indicated by ○.

Since the sinusoid 12 cannot be set to the continuation mode, the birth mode is set to the sinusoid 12, which is indicated by ●.

A third frame includes three sinusoids 13, 14, and 15.

The sinusoid 13 is set to the continuation mode (indicated by ○), where the sinusoid 11 is its previous track component. The sinusoid 14 is set to the continuation mode (indicated by ○), where the sinusoid 12 is its previous track component.

Regarding the sinusoid 15, since there is no sinusoid in the previous frame from which the sinusoid 15 can be continued, the sinusoid 15 is set to the birth mode (indicated by ●).

A fourth frame includes four sinusoids 16 to 19.

The sinusoid 16 is set to the birth mode (indicated by ●). The sinusoid 17 is set to the continuation mode (indicated by ○), where the sinusoid 13 is its previous track component. The sinusoid 18 is set to the continuation mode (indicate by ○), where the sinusoid 14 is its previous track component.

The sinusoid 19 is set to the continuation mode (indicated by ○), where the sinusoid 15 is its previous track component.

A fifth frame includes four sinusoids 20 to 23.

The sinusoid 20 is set to the continuation mode (indicated by ○), where the sinusoid 16 is its previous track component. The sinusoid 21 is set to the continuation mode (indicated by ○), where the sinusoid 17 is its previous track component. The sinusoid 22 is set to the continuation mode (indicated by ○), where the sinusoid 18 is its previous track component. The sinusoid 23 is set to the continuation mode (indicated by ○), where the sinusoid 19 is its previous track component.

In FIG. 5, the sinusoids 12 and 16 are within the range that can be respectively continued from the sinusoids 10 and 13. However, since the sinusoids 12 and 16 are set to the birth mode, more bits of coded data are required in comparison with the case of the continuation mode. Therefore, according to the present invention, the sinusoids 12 and 16 are set to the branch mode, and thus the number of bits of coded data can be further reduced than the case of the birth mode.

FIG. 6 illustrates sinusoid tracking according to an exemplary embodiment of the present invention.

Referring to FIG. 6, a second frame includes sinusoids 11 and 12. Both the sinusoids 11 and 12 can be continued from a sinusoid 10. Between the two sinusoids 11 and 12, one sinusoid nearest to the sinusoid 10 is set to the continuation mode, and the other sinusoid is set to the branch mode.

Therefore, the sinusoid 11 is set to the continuation mode, where the sinusoid 10 is its previous track mode.

The sinusoid 12 is set to the branch mode, where the sinusoid 10 is its previous track mode. This is indicated by ◎ in FIG. 6.

A fourth frame includes sinusoids 16 to 19.

In FIG. 5, the sinusoid 17 nearest to the sinusoid 13 of its previous frame is set to the continuation mode, whereas the sinusoid 16 is set to the birth mode.

In FIG. 6, a sinusoid 16 is set to the branch mode (indicated by ◎), where a sinusoid 13 of the previous frame is its previous track component.

When set to the birth mode, an amplitude, a frequency, and a phase of a frequency component are coded.

When set to the continuation mode, coding is performed through a DPCM or an ADPCM using a difference between a frequency component and a previous track component.

When set to the branch mode, similar to the case of the continuation mode, the DPCM or the ADPCM may be used for coding.

Accordingly, when set to the continuation mode or the branch mode, the number of bits of coded data decreases.

For example, when set to the birth mode, the number of required bits for the respective frequency components ranges from 15 to 47. On the other hand, when set to the continuation mode or the branch mode, the number of required bits ranges from 3 to 17.

Figure 7:
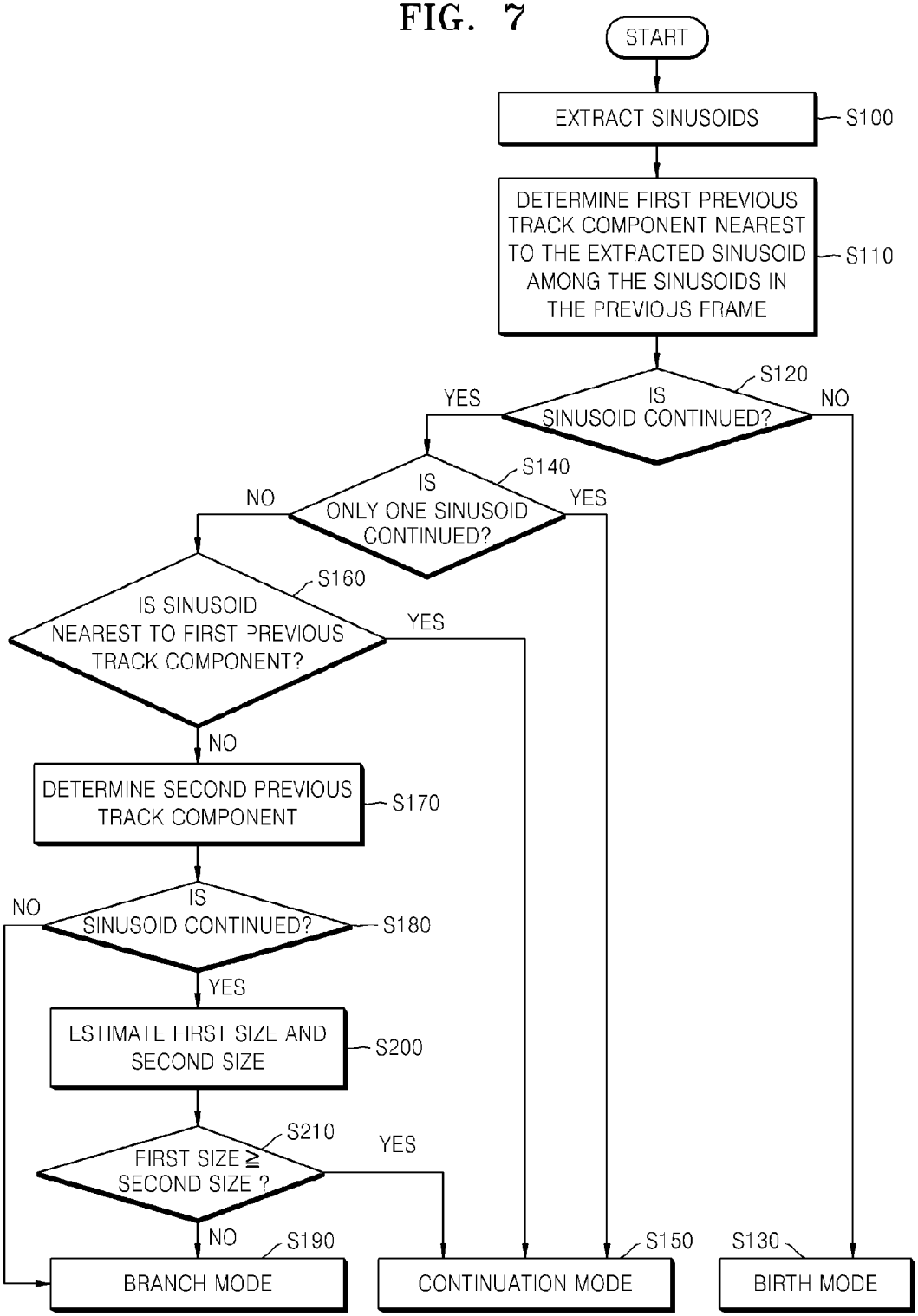
FIG. 7 is a flowchart of a sinusoidal audio coding method according to an exemplary embodiment of the present invention.

FIG. 7 is a flowchart of a sinusoidal audio coding method according to an exemplary embodiment of the present invention.

First, the sinusoidal analyzer 110 extracts sinusoids by performing a sinusoidal analysis on an input audio signal (operation S100).

The previous track component determining unit 122 determines a first previous track component which is included in a previous frame and is nearest to a sinusoid whose mode is to be set at the moment (operation S110).

The continuity determining unit 124 determines whether the sinusoid can be continued from the first previous track component (operation S120).

If this sinusoid cannot be continued from the first previous track component, the sinusoid is set to the birth mode (operation S130).

For example, in sinusoid 15 of FIG. 6, the sinusoids 13 to 15 are first extracted from the third frame (current frame) (operation S100).

Once the sinusoids 13 and 14 are set to a certain mode, the sinusoid 15 is a sinusoid whose mode is to be set.

With respect to the sinusoid 15, the sinusoid 12 of a previous frame (the second frame) is the nearest sinusoid (operation S110).

However, the sinusoid 15 is not within the range that can be continued from the sinusoid 12 (operation S120). Therefore, the sinusoid 15 is set to the birth mode (operation S130).

On the other hand, if the sinusoid whose mode is to be set at the moment can be continued from the first previous track component, the sinusoid is set to the continuation mode or the branch mode.

The continuation mode/branch mode setting unit 128 determines how many sinusoids of the current frame can be continued from the first previous track component and also determines whether only one sinusoid is continued (operation S140). If only one sinusoid is continued, this corresponds to the conventional continuation mode. According to the present invention, the sinusoid whose mode is to be set is also set to the continuation mode, where its previous track component is the first previous track component (operation S150).

If a plurality of sinusoids can be continued, the sinusoid whose mode is to be set at the moment is compared with other frequency components. Then, only a sinusoid nearest to the first previous track component is set to the continuation mode, where the previous track component is the first previous track component.

The continuation mode/branch mode setting unit 128 determines whether the sinusoid whose mode is to be set is nearest to the first previous track component among sinusoids continued from the first previous track component (operation S160). If the sinusoid is nearest to the first previous track component, the sinusoid whose mode is to be set is set to the continuation mode, where its previous track component is the first previous track component (operation S150).

If the sinusoid is not nearest to the first previous track component, sinusoids are extracted which are included in a previous frame and are not assigned as previous track components for sinusoids of the current frame. Then, among these extracted sinusoids, a sinusoid nearest to a sinusoid whose mode is to be set at the moment is searched for (operation S170). The found sinusoid is referred to as a second previous track component.

The continuation mode/branch mode setting unit 128 determines whether the sinusoid whose mode is to be set at the moment can be continued from the second previous track component (operation S180). If the sinusoid cannot be continued from the second previous track component, only the first previous track component can be continued from the sinusoid whose mode is to be set at the moment. Thus, the sinusoid is set to the branch mode, where its previous track component is the first previous track component (operation S190).

If the sinusoid can be continued from the second previous track component, both the first and second track components can be continued from the sinusoid whose mode is to be set at the moment. In this case, one of the first and second track components has to be determined in consideration of further effective coding. Therefore, there is a need to compare the following two cases: Case A in which the sinusoid is set to the branch mode, where its previous track component is the first previous track component; and Case B in which the sinusoid is set to the continuation mode, where its previous track component is the second previous track component.

The continuation mode/branch mode setting unit 128 estimates a data size of coded data for Case A and Case B (operation S200). First, the data size is estimated for Case A and is defined as a first size. Thereafter, the data size is estimated for Case B and is defined as a second size.

The first size is compared with the second size (operation S210). If the first size is equal to or greater than the second size, coding can be more effectively performed in Case B. Thus, the sinusoid is set to the continuation mode, where its previous track component is the second previous track component (operation S150).

On the other hand, if the first size is less than the second size, Case A is more effective for coding. Thus, the sinusoid is set to the branch mode, where its previous track component is the first previous track component (operation S190).

Figure 8:
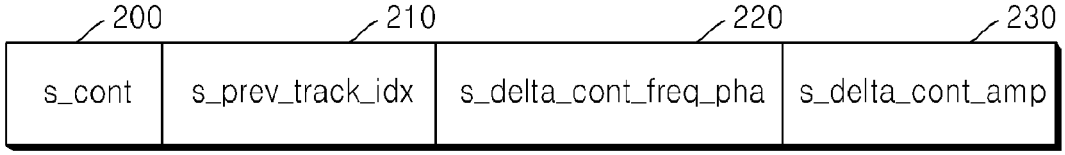
FIG. 8 illustrates a data format that has been coded in a branch mode according to an exemplary embodiment of the present invention.

FIG. 8 illustrates a data format that has been coded in a branch mode according to an exemplary embodiment of the present invention. The operation of the branch mode coder 136 will now be described in detail with reference to FIG. 8.

When a sinusoid is set to the branch mode, the branch mode coder 136 generates data in the format of FIG. 8.

An s_cont 200 indicates the number of sinusoids continued from a current sinusoid among sinusoids of subsequent frames. The s_cont 200 will be described later in greater detail with reference to FIG. 9.

An s_prev_track_idx 210 indicates a previous track component of the current sinusoid.

The s_delta_cont_freq_pha 220 indicates a frequency difference and a phase difference between the current sinusoid and the previous track component.

An s_delta_cont_amp 230 indicates an amplitude difference between the current sinusoid and the previous track component.

Figure 9:
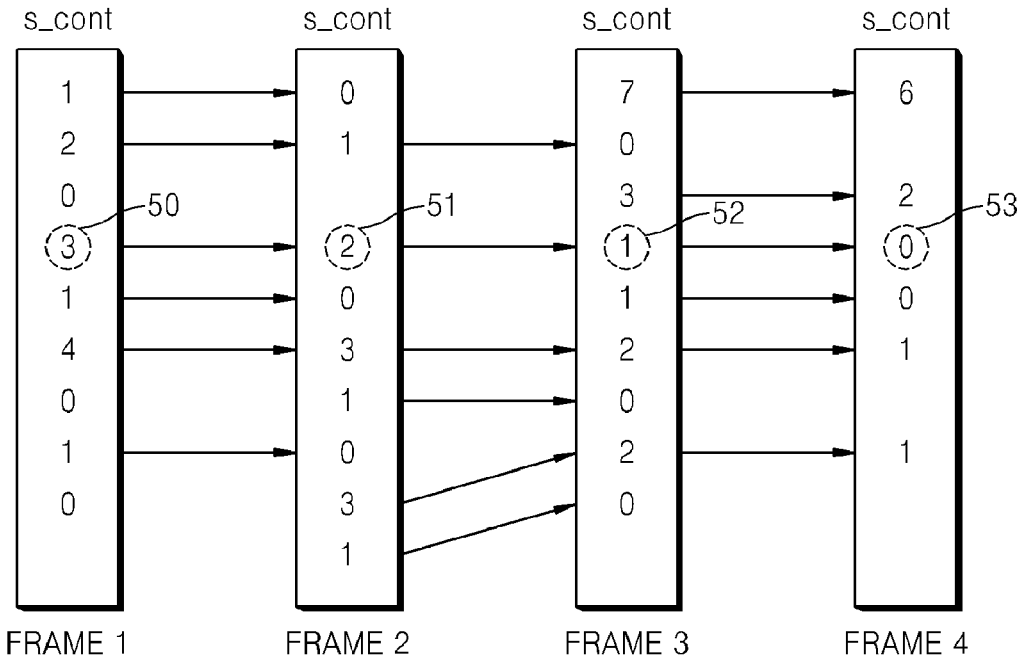
FIG. 9 is an illustration for explaining a concept of s_cont.

FIG. 9 is an illustration for explaining a concept of s_cont.

Regarding a sinusoid 50 included in a frame 1, sinusoids 51, 52, and 53 respectively included in subsequent frames 2, 3, 4 are continued from the current sinusoid 50. Thus, s_count of the sinusoid 50 is 3.

Likewise, regarding the sinusoid 51 included in the frame 2, the sinusoids 52 and 53 respectively included in the subsequent frames 3 and 4 are continued from the current sinusoid 51. Thus, s_count of the sinusoid 51 is 2.

According to the present invention, a plurality of sinusoids that can be continued from one previous track component are set to a continuation mode or a branch mode, and only a difference between a current sinusoid and a previous track component in terms of a frequency, a phase, and an amplitude is coded. Therefore, advantageously, the number of bits of coded data is significantly reduced, compared with the case of a birth mode.

The invention can also be embodied as a computer program on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices.

The computer system adapted to execute the invention may include a processor, and a memory under control of the processor and including the computer program enabling the computer system to perform the invention.

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A sinusoidal audio coding method comprising:

extracting sinusoids of a current frame by performing a sinusoidal analysis on an input audio signal;

with respect to each of the extracted sinusoids of the current frame, setting a mode selected from a birth mode in which a sinusoid being set for coding is newly generated irrespective of sinusoids of a previous frame, a continuation mode in which the sinusoid being set for coding is an only sinusoid of the extracted sinusoids of the current frame that is continued from a same sinusoid of the sinusoids of the previous frame, and a branch mode in which the sinusoid being set for coding is one of a plurality of sinusoids of the current frame that are continued from the same sinusoid of the sinusoids of the previous frame; and coding the extracted sinusoids according to the selected mode.

2. The sinusoidal audio coding method of claim 1, wherein the setting of a mode comprises:

determining a first previous track component which is included in the sinusoids of the previous frame and is nearest to a sinusoid whose mode is to be set;

determining whether the sinusoid whose mode is to be set can be continued from the first previous track component;

if the sinusoid whose mode is to be set cannot be continued from the first previous track component, setting the mode of the sinusoid to the birth mode; and if the sinusoid whose mode is to be set can be continued from the first previous track component, setting the mode of the sinusoid to the continuation mode or the branch mode, where one of the sinusoids of the previous frame is assigned as its previous track component.

3. The sinusoidal audio coding method of claim 2, wherein the determining of a first previous track component comprises selecting the first previous track component from the sinusoids of the previous frame having a smallest frequency difference with respect to the sinusoid whose mode is to be set.

4. The sinusoidal audio coding method of claim 2, wherein the setting of the mode of the sinusoid to the continuation mode or the branch mode comprises, if only one sinusoid is continued from the first previous track component among the extracted sinusoids, setting the mode of the sinusoid to the continuation mode, where the first previous track component is assigned as its previous track component.

5. The sinusoidal audio coding method of claim 4, wherein the setting of the mode of the sinusoid to the continuation mode or the branch mode further comprises:

if a plurality of sinusoids are continued from the first previous track component among the extracted sinusoids, determining whether the sinusoid whose mode is to be set is nearest to the first previous track component among the sinusoids continued from the first previous track component; and if the sinusoid whose mode is to be set is nearest to the first previous track component, setting the mode of the sinusoid to the continuation mode, where the first previous track component is assigned as its previous track component.

6. The sinusoidal audio coding method of claim 5, wherein the setting of the mode of the sinusoid to the continuation mode or the branch mode further comprises:

if the sinusoid whose mode is to be set is not nearest to the first previous track component, determining a second previous track component nearest to the sinusoid whose mode is to be set from the sinusoids which are included in the previous frame and are not assigned as previous track components of the sinusoids of the current frame;

determining whether the sinusoid whose mode is to be set can be continued from the second previous track component;

if the sinusoid whose mode is to be set cannot be continued from the second previous track component, the mode of the sinusoid is set to the branch mode, where the first previous track component is assigned as its previous track component; and if the sinusoid whose mode is to be set can be continued from the second previous track component, setting the mode of the sinusoid by comparing a data size of coded data obtained in the continuation mode and a data size of coded data obtained in the branch mode.

7. The sinusoidal audio coding method of claim 6, wherein the setting of the mode of the sinusoid by comparing data sizes comprises:

obtaining a first data size which results from a coding when the sinusoid is set to the branch mode, where its previous track component is the first previous track component;

obtaining a second data size which results from a coding when the sinusoid set to the continuation mode, where its previous track component is the second previous track component;

if the first size is less than the second size, setting the mode of the sinusoid to the branch mode, where the first previous track component is assigned as its previous track component; and if the first size is equal to or greater than the second size, setting the mode of the sinusoid to the continuation mode, where the second previous track component is assigned as its previous track component.

8. The sinusoidal audio coding method of claim 6, wherein the determining of a second previous track component comprises selecting the second previous track component from the sinusoids which are included in the previous frame and are not assigned as previous track component of sinusoids of the current frame, where the selected second previous track component has the smallest frequency difference with respect to the sinusoid whose mode is to be set.

9. The sinusoidal audio coding method of claim 2, wherein continuity of sinusoids is determined according to whether a frequency difference between sinusoids whose continuity is being determined is equal to or less than a predetermined value.

10. The sinusoidal audio coding method of claim 2, wherein continuity of sinusoids is determined according to whether a frequency difference between the sinusoids is equal to or less than a predetermined value and whether an amplitude ratio of the sinusoids is equal to or less than another predetermined value.

11. The sinusoidal audio coding method of claim 1, wherein the coding of the extracted sinusoids comprises, if the mode of the extracted sinusoid is the branch mode, generating data including a value indicating the number of sinusoids continued from the extracted sinusoid among sinusoids of subsequent frames, a previous track component of the extracted sinusoid, a value indicating a frequency difference and a phase difference between the extracted sinusoid and the previous track component, and a value indicating an amplitude difference between the extracted sinusoid and the previous track component.

12. A sinusoidal audio coding apparatus comprising:

a sinusoidal analyzer which extracts sinusoids of a current frame by performing a sinusoidal analysis on an input audio signal;

a mode setting unit which sets a mode selected from a birth mode in which a sinusoid of the current frame being set for coding is newly generated irrespective of sinusoids of a previous frame, a continuation mode in which the sinusoid of the current frame being set for coding is an only sinusoid of the extracted sinusoids of the current frame that is continued from a same sinusoid of the sinusoids of the previous frame, and a branch mode in which the sinusoid of the current frame being set for coding is one of a plurality of sinusoids of the current frame that are continued from the same sinusoid of the sinusoids of the previous frame, with respect to each of the extracted sinusoids; and a sinusoid coder which encodes the extracted sinusoids according to the selected mode.

13. The sinusoidal audio coding apparatus of claim 12, wherein the mode setting unit comprises:

a previous track component determining unit which determines a first previous track component which is included in the sinusoids of the previous frame and is nearest to a sinusoid whose mode is to be set;

a continuity determining unit which determines whether the sinusoid whose mode is to be set can be continued from the first previous track component;

a birth mode setting unit which sets the mode of the sinusoid whose mode is to be set to the birth mode if the sinusoid cannot be continued from the first previous track component; and a continuation mode/branch mode setting unit which sets the mode of the sinusoid whose mode is to be set to the continuation mode or the branch mode, and assigns one of the sinusoids of the previous frame as its previous track component, if the sinusoid can be continued from the first previous track component.

14. The sinusoidal audio coding apparatus of claim 13, wherein the previous track component determining unit selects the first previous track component from the sinusoids of the previous frame having a smallest frequency difference with respect to the sinusoid whose mode is to be set.

15. The sinusoidal audio coding apparatus of claim 13, wherein the continuation mode/branch mode setting unit sets the mode of the sinusoid whose mode is to be set to the continuation mode, where the first previous track component is assigned as its previous track component, if only one sinusoid is continued from the first previous track component among the extracted sinusoids.

16. The sinusoidal audio coding apparatus of claim 15, wherein the continuation mode/branch mode setting unit determines whether the sinusoid whose mode is to be set is nearest to the first previous track component among the sinusoids continued from the first previous track component if a plurality of sinusoids are continued from the first previous track component among the extracted sinusoids, and, if the sinusoid whose mode is to be set is nearest to the first previous track component, sets the mode of the sinusoid to the continuation mode the first previous track component is assigned as its previous track component.

17. The sinusoidal audio coding apparatus of claim 16, wherein, if the sinusoid whose mode is to be set is not nearest to the first previous track component, the continuation mode/branch mode setting unit determines a second previous track component nearest to the sinusoid whose mode is to be set from the sinusoids which are included in the previous frame and are not assigned as previous track components of the sinusoids of the current frame and determines whether the sinusoid whose mode is to be set can be continued from the second previous track component, wherein, if the sinusoid whose mode is to be set cannot be continued from the second previous track component, the continuation mode/branch mode setting unit sets the mode of the sinusoid to the branch mode, where the first previous track component is assigned as its previous track component, and wherein, if the sinusoid whose mode is to be set can be continued from the second previous track component, the continuation mode/branch mode setting unit sets the mode of the sinusoid by comparing a data size of coded data obtained in the continuation mode and a data size of coded data obtained in the branch mode.

18. The sinusoidal audio coding apparatus of claim 17, wherein, if the sinusoid whose mode is to be set can be continued from the second previous track component, the continuation mode/branch mode setting unit obtains a first data size which results from a coding when the sinusoid is set to the branch mode, where its previous track component is the first previous track component, and obtains a second data size which results from a coding when the sinusoid set to the continuation mode, where its previous track component is the second previous track component, wherein, if the first size is less than the second size, the continuation mode/branch mode setting unit sets the mode of the sinusoid to the branch mode, where the first previous track component is assigned as its previous track component, and wherein, if the first size is equal to or greater than the second size, the continuation mode/branch mode setting unit sets the mode of the sinusoid to the continuation mode, where the second previous track component is assigned as its previous track component.

19. The sinusoidal audio coding apparatus of claim 17, wherein the continuation mode/branch mode setting unit selects the second previous track component from the sinusoids which are included in the previous frame and are not assigned as previous track component of sinusoids of the current frame, where the selected second previous track component has the smallest frequency difference with respect to the sinusoid whose mode is to be set.

20. The sinusoidal audio coding apparatus of claim 13, wherein continuity of sinusoids is determined according to whether a frequency difference between sinusoids is equal to or less than a predetermined value.

21. The sinusoidal audio coding apparatus of claim 13, wherein continuity is determined according to whether a frequency difference between the sinusoids is equal to or less than a predetermined value and whether an amplitude ratio of the sinusoids is equal to or less than another predetermined value.

22. The sinusoidal audio coding apparatus of claim 12, wherein, if the extracted sinusoid is the branch mode, the sinusoid coder includes branch mode coder which generates data including a value indicating the number of sinusoids continued from the extracted sinusoid among sinusoids of subsequent frames, a previous track component of the extracted sinusoid, a value indicating a frequency difference and a phase difference between the extracted sinusoid and the previous track component, and a value indicating an amplitude difference between the extracted sinusoid and the previous track component.

23. A computer-readable medium having embodied thereon a computer program for executing a sinusoidal audio coding method comprising:

extracting sinusoids of a current frame by performing a sinusoidal analysis on an input audio signal;

with respect to each of the extracted sinusoids of the current frame, setting a mode selected from a birth mode in which a sinusoid being set for coding is newly generated irrespective of sinusoids of a previous frame, a continuation mode in which the sinusoid being set for coding is an only sinusoid of the extracted sinusoids of the current frame that is continued from a same sinusoid of the sinusoids of the previous frame, and a branch mode in which the sinusoid being set for coding is one of a plurality of sinusoids of the current frame that are continued from the same sinusoid of the sinusoids of the previous frame; and coding the extracted sinusoids according to the selected mode.

24. A computer system adapted to execute a sinusoidal audio coding method, comprising:

a processor, and a memory under control of the processor and including a computer program enabling the computer system to perform operations comprising:

extracting sinusoids of a current frame by performing a sinusoidal analysis on an input audio signal;

with respect to each of the extracted sinusoids of the current frame, setting a mode selected from a birth mode in which a sinusoid being set for coding is newly generated irrespective of sinusoids of a previous frame, a continuation mode in which the sinusoid being set for coding is an only sinusoid of the extracted sinusoids of the current frame that is continued from a same sinusoid of the sinusoids of the previous frame, and a branch mode in which the sinusoid being set for coding is one of a plurality of sinusoids of the current frame that are continued from the same sinusoid of the sinusoids of the previous frame; and coding the extracted sinusoids according to the selected mode.

25. A sinusoidal audio coding method comprising:

extracting sinusoids of a current frame by performing a sinusoidal analysis on an input audio signal;

with respect to each of the extracted sinusoids, setting a mode selected from a birth mode in which a sinusoid is newly generated irrespective of sinusoids of a previous frame, a continuation mode in which the sinusoid is only one sinusoid continued from one of the sinusoids of the previous frame or the sinusoid is a nearest sinusoid among a plurality of sinusoids continued from one of the sinusoids of the previous frame, and a branch mode in which the sinusoid is one of a plurality of sinusoids except the nearest sinusoid continued from one of the sinusoids of the previous frame; and coding the extracted sinusoids according to the selected mode.

26. A sinusoidal audio coding apparatus comprising:

a sinusoidal analyzer extracting sinusoids of a current frame by performing a sinusoidal analysis on an input audio signal;

a mode setting unit setting a mode selected from a birth mode in which a sinusoid is newly generated irrespective of sinusoids of a previous frame, a continuation mode in which the sinusoid is only one sinusoid continued from one of the sinusoids of the previous frame or the sinusoid is a nearest sinusoid among a plurality of sinusoids continued from one of the sinusoids of the previous frame, and a branch mode in which the sinusoid is one of a plurality of sinusoids except the nearest sinusoid continued from one of the sinusoids of the previous frame, with respect to each of the extracted sinusoids; and a sinusoid coder coding the extracted sinusoids according to the selected mode.

27. A computer-readable medium having embodied thereon a computer program for executing a sinusoidal audio coding method, the method comprising:

extracting sinusoids of a current frame by performing a sinusoidal analysis on an input audio signal;

with respect to each of the extracted sinusoids, setting a mode selected from a birth mode in which a sinusoid is newly generated irrespective of sinusoids of a previous frame, a continuation mode in which the sinusoid is only one sinusoid continued from one of the sinusoids of the previous frame or the sinusoid is a nearest sinusoid among a plurality of sinusoids continued from one of the sinusoids of the previous frame, and a branch mode in which the sinusoid is one of a plurality of sinusoids except the nearest sinusoid continued from one of the sinusoids of the previous frame; and coding the extracted sinusoids according to the selected mode.

* * * * *